United States Patent [19]

Höglund

[11] Patent Number: 4,986,105

[45] Date of Patent: Jan. 22, 1991

[54] MACHINE FOR CORRUGATING SHEET METAL OR THE LIKE

[75] Inventor: Nils G. Höglund, Bjästa, Sweden

[73] Assignee: Aktiebolaget Br. Hoglunds Maskinuthyrning, Kopmanholmen, Sweden

[21] Appl. No.: 312,705

[22] PCT Filed: Aug. 6, 1987

[86] PCT No.: PCT/SE87/00354

§ 371 Date: Feb. 13, 1989

§ 102(e) Date: Feb. 13, 1989

[87] PCT Pub. No.: WO88/01208

PCT Pub. Date: Feb. 25, 1988

[30] Foreign Application Priority Data

Aug. 15, 1986 [SE] Sweden ..... 8603433

[51] Int. Cl.[5] ..... B21D 5/14

[52] U.S. Cl. ..... 72/180

[58] Field of Search ..... 72/180–182, 72/178, 177; 493/463, 439, 440

[56] References Cited

U.S. PATENT DOCUMENTS

| | | | |
|---|---|---|---|
| 1,941,484 | 1/1934 | Nasmith | 72/234 |
| 2,163,063 | 8/1937 | Romanoff . | |
| 2,643,591 | 6/1953 | Overland et al. | 493/440 |
| 2,649,888 | 4/1954 | Fay . | |
| 2,811,989 | 11/1957 | Henderson et al. | 72/180 |
| 3,059,685 | 10/1962 | Behlen | 72/180 |
| 3,251,211 | 4/1963 | Harris . | |

FOREIGN PATENT DOCUMENTS

| | | | |
|---|---|---|---|
| 75843 | 12/1893 | Belgium . | |
| WO84/01911 | 5/1984 | European Pat. Off. . | |
| 19949 | 11/1882 | Fed. Rep. of Germany | 72/180 |
| 465421 | 9/1928 | Fed. Rep. of Germany | 72/164 |
| 823629 | 6/1937 | France . | |
| 867034 | 9/1941 | France . | |
| 162228 | 7/1986 | Japan | 72/180 |
| 587639 | 10/1933 | Netherlands . | |
| 189658 | 7/1905 | Sweden . | |
| 2941180A1 | 10/1979 | Sweden . | |
| 1211835 | 2/1969 | United Kingdom . | |

*Primary Examiner*—Daniel C. Crane

*Attorney, Agent, or Firm*—McFadden, Fincham Marcus & Allen

[57] ABSTRACT

A machine for corrugating sheet metal or the like comprises a plurality of successive working stations each provided with upper and lower rotatable corrugating devices adapted to jointly provide corrugations of successively increasing depth in a metal sheet (6) which is successively advanced through the machine from a front station toward a rear station. According to the invention, both the upper and the lower corrugating device at each station comprises a plurality of rollers (13, 16) which are individually mounted and thus rotatable at optionally variable peripheral speeds. The rollers (13, 16) preferably are adjustably movable in the direction of their axes of rotation and lockable at desired spaced-apart locations.

5 Claims, 4 Drawing Sheets

MACHINE FOR CORRUGATING SHEET METAL OR THE LIKE

TECHNICAL FIELD OF THE INVENTION

The present invention relates to a machine for corrugating sheet metal or the like, comprising a plurality of successive working stations each provided with upper and lower rotatable corrugating devices adapted to jointly provide corrugations of successively increasing depth in a metal sheet which is successively advanced through the machine from a front station toward a rear station.

BACKGROUND OF THE INVENTION

The corrugating devices of prior art machines of this type consist of corrugating rollers in the form of rotatable shafts on which rings are mounted or formed having a cross-sectional shape corresponding to the desired profile to be imparted to the sheet at the station comprising the two corrugating devices at issue. More particularly, the rings of the first or front working station are fairly thin to give shallow corrugations in a first working pass, whereupon the radial thickness of the corrugations is increased successively at subsequent stations in order to give, at a last station, the desired final corrugation depth. In actual practice, however, the use of such ring-carrying shafts as corrugating devices suffers from a number of shortcomings. Since the rings are fixedly mounted on their associated shafts, the peripheral speed at the circumferential or ridge surface of the ring will be different from the peripheral speed of the neighbouring furrows forming portions of the shaft proper, which have a smaller diameter than the ring. This means that the sheet which is being worked will constantly partially slip when in contact with the respective surfaces, and this may lead to inadequate precision and surface damage in the finished product. Furthermore, readjustment of the various corrugating devices of the machine from one corrugation type to another is extremely complicated and time-consuming. For example, readjustment of a prior art machine comprising about 20 working stations may take from 25 to 35 days' work, and this means that small and medium-sized manufacturers are subjected to extensive and costly interruptions when shifting from one corrugation type to another. To large-scale manufacturers with many corrugation types on their production program, such long interruptions are unacceptable, and they are therefore compelled to acquire a separate corrugating machine for each individual corrugation type on their program. This in turn implies extremely high capital costs, and even then long interruptions cannot be avoided if the machine cannot be operated to capacity over a longer period of time.

BRIEF DESCRIPTION OF THE INVENTION

The present invention aims at providing a corrugating machine which does not suffer from the above-mentioned shortcomings and which, in particular, produces corrugated metal sheets with good precision. This is achieved, according to the principal feature of the invention, in that the rollers are individually rotatable as well as thin or disk-shaped and adapted to cooperate in pairs, such that a pair of adjacent rollers in the upper corrugating device determine the shape or width of a lower flange of the sheet at issue, simultaneously as a pair of adjacent rollers in the lower corrugating device determine the shape or width of an upper flange of said sheet.

BRIEF DESCRIPTION OF THE ACCOMPANYING DRAWINGS

In the drawings, FIG. 1 is a partially cut assembly view of a corrugating machine according to the invention;

DETAILED DESCRIPTION OF A PREFERRED EMBODIMENT OF THE INVENTION

Figure 1:
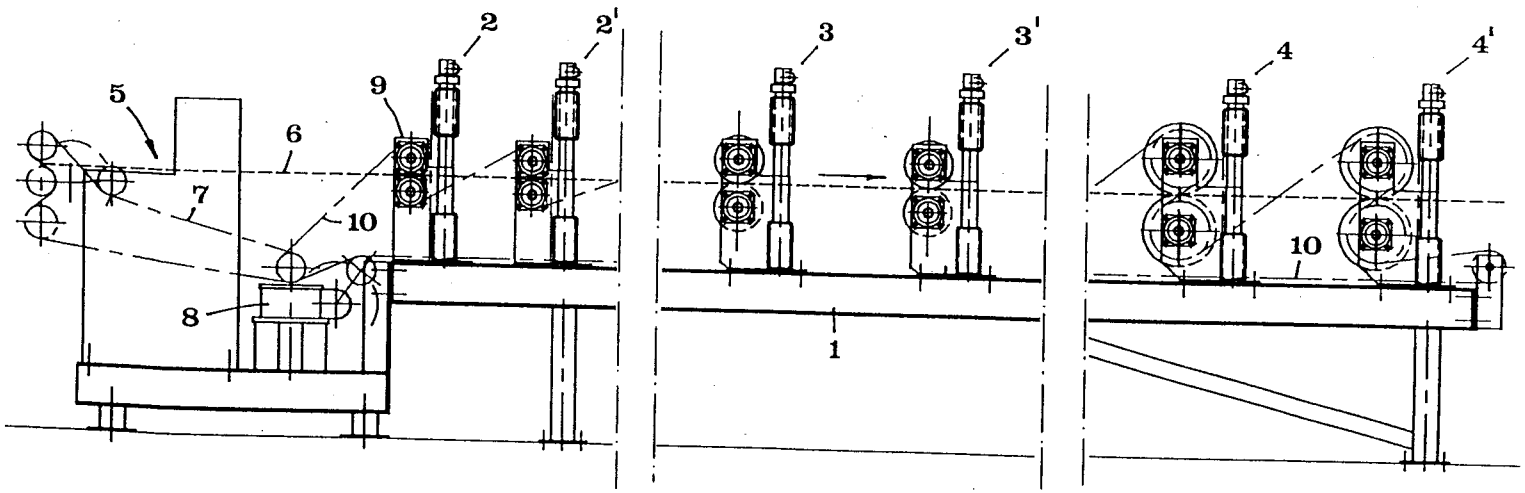

In FIG. 1, a framework according to the invention, generally designated 1, carries a multiplicity of successively aligned working stations 2, 2', 3, 3', 4, 4'. In actual practice, the machine may comprise from 15 to 30 working stations, preferably from 20 to 25, of which but 6 are shown in the drawing to facilitate viewing. Ahead of the first or front working station 2 in the machine, there is mounted a coiling device 5 adapted to receive a sheet metal coil from which a sheet 6 can be uncoiled and passed through the successive machine stations. The coiling device is operable, via a transmission 7, by means of the same motor or driving device 8 which is used for driving individual pairs of feeding wheels 9 at each station, via an endless chain 10 which is common to all working stations. The sheet to be corrugated in the machine preferably consists of conventional plastic-coated hot-dip galvanised steel sheet having a thickness in the range 0.5–1.0 mm.

Figure 2:
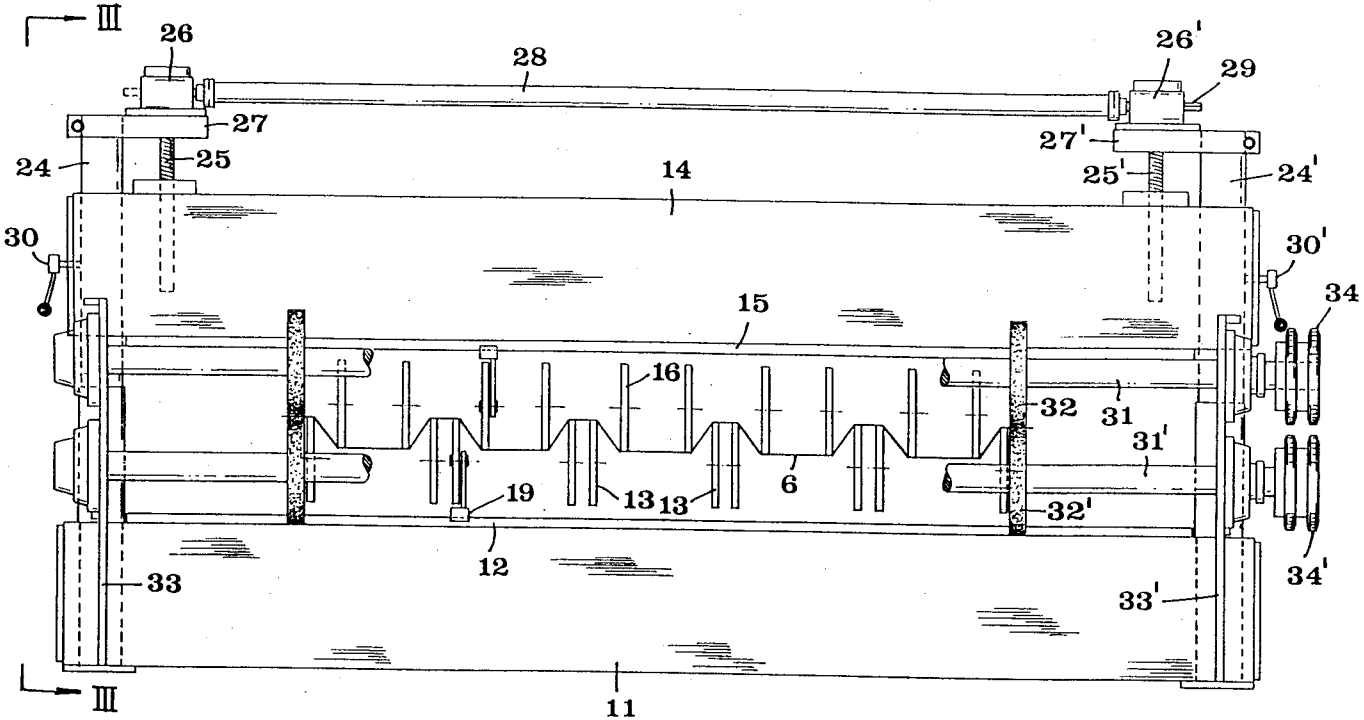
FIG. 2 is an enlarged front view of an individual working station comprised by said machine.
Figure 3:
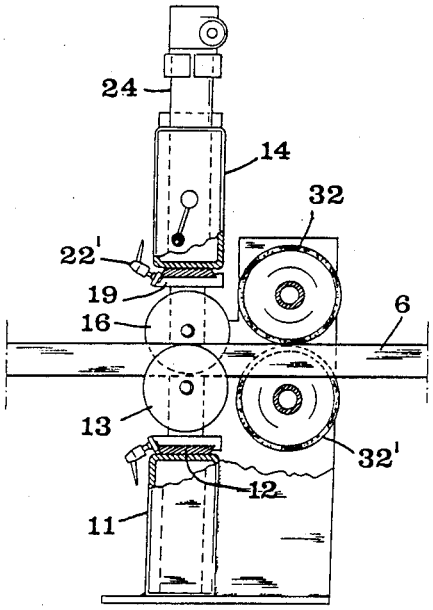
FIG. 3 is a partially cut side view on line III—III in FIG. 2.

FIGS. 2 and 3 illustrate in greater detail the construction of the individual working station. Mounted on a lower beam 11 fixedly secured to the framework 1 is a first guide in the form of a rail 12 on which there is mounted a first set of rollers 13 which jointly form the lower corrugating device of the working station. An upper beam 14 is provided, in analogous manner, with a second guide 15 which also is in the form of a rail and on which a second set of rollers 16 are mounted which jointly form an upper corrugating device.

Figure 6:
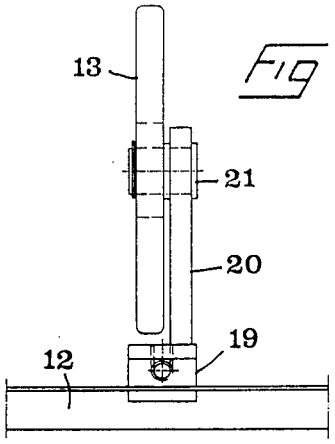
FIGS. 4–6 are respectively side, top plan and front views of an individual corrugating roller comprised by the said station.
Figure 5:
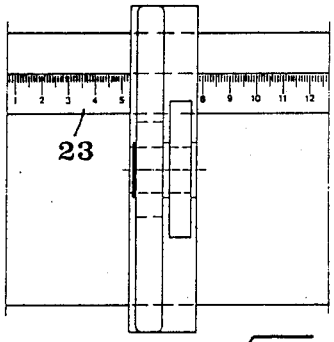
Figure 4:
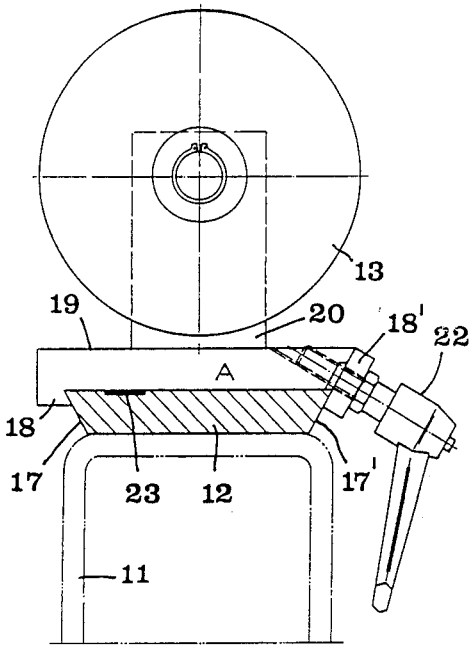

As is best seen from FIG. 4, the lower guide 12 has two chamfered downwardly converging side surfaces 17, 17' cooperating with two spaced-apart projections 18, 18' on a sliding block 19 on which a vertical standard 20 is mounted which in turn carries the corrugating roller 13. The standard 20 is in the form of a relatively thin plate having a throughhole for a journal 21 on which the relatively thin and disk-shaped roller 13 is rotatably mounted. The projection 18 has a contact surface abutting the surface 17 and chamfered at the same angle as the surface 17. The projection 18' is in the form of a pressure plate, the plane of which has the same slope as the chamfered guide surface 17'. By means of a screw or clamp mechanism generally designated 22, the plate can be clamped against the sliding block 19. It will be appreciated that the sliding block 19 on which the roller 13 is mounted can be locked in a distinctly defined position relative to the guide 12 upon tensioning of the clamp mechanism 22, and also that it is freely movable into optional positions along the guide after said clamp mechanism 22 has been released. To facilitate adjustment of the individual sliding blocks along the common guide, a graduated measure may preferably be provided on the upper side of the guide. It appears from FIGS. 5 and 6 that not only the roller disk 13 and the standard plate 20, but also the underlying sliding block are relatively narrow, implying that two sliding blocks and roller plates can be located very close to one another along the guide. In actual practice, the roller disk 13 has a thickness of about 10 mm, while the sliding block has a width of 25 mm.

Also the rollers 16 of the upper roller set are mounted on sliding blocks 19' which are movable, in the manner described above, along the guide 15 and can be locked in optional positions along said guide by means of clamp mechanisms 22'.

The upper support beam 14 is vertically movable relative to the lower beam to permit variation of the level of the upper rollers 16 in relation to the lower rollers 13. To this end, the beam 14 is at opposite ends in engagement with vertical guides or standards 24, 24' and two synchronously rotatable screws 25, 25' by means of which said beam can be raised and lowered relative to the standards. More particularly, the screws 25, 25' are connected with two worm gears 26, 26' mounted on brackets 27, 27' on the upper part of the respective standard. The worm gears 26, 26' are interconnected via a shaft 28 transmitting the rotary movement of an input driving journal 29 from one worm gear to the other in such a manner that the two screws 25, 25' will positively rotate at exactly the same speed when the beam 14 is raised or lowered. In other words, the beam will always be exactly horizontal irrespective of its adjusted position. After vertical movement, the beam 14 can be locked relative to the standards by means of separate locking mechanisms 30, 30'.

In the area ahead of the corrugating rollers 13, 16, each mounting station comprises two shafts 31, 31' which carry two pairs of cooperating drive wheels 32, 32' and are mounted in vertical holders 33, 33', at least the upper shaft 31 being vertically movable and urged toward the lower shaft by suitable springs (not shown) serving to distinctly pinch the sheet 6 between the drive wheels 32, 32'. These drive wheels preferably have a rubber coating which provides for gentle contact with the sheet, while simultaneously exerting a considerable frictional force against the sheet, thereby to promote the feeding capacity. At one end of each of the said two shafts 31, 31' gear or chain wheels 34, 34' are mounted which engage the endless driving chain 10 which is common to all working stations.

FUNCTION AND ADVANTAGES OF THE MACHINE ACCORDING TO THE INVENTION

Figure 7:
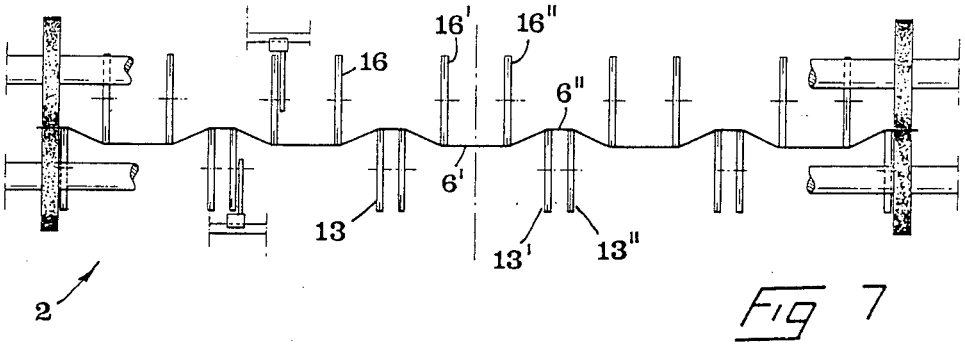
FIGS. 7 and 8 are schematic front views illustrating the working of a metal sheet in two different successive passes.
Figure 8:
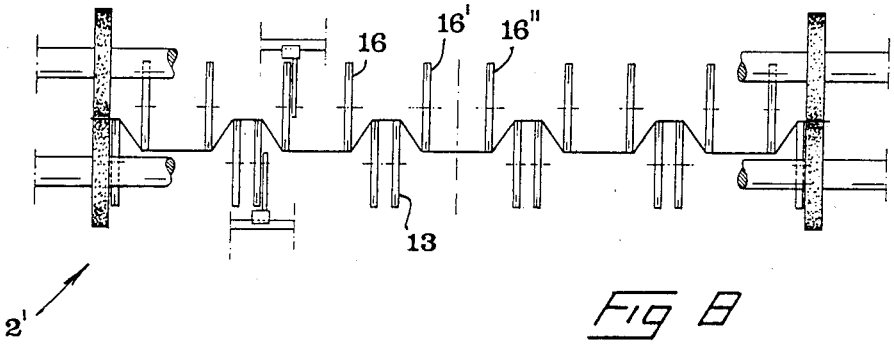

The function of the machine is best seen from a comparison between FIGS. 7 and 8. FIG. 7 illustrates a working station in the front part of the machine, for example the very first station 2 at which the adjustable beam 14 has been set to a relatively high position with respect to the lower beam 11, such that the lower edge of the upper corrugating rollers 16 are at a relatively low level below the upper edge of the lower corrugating rollers 13. It should be noted that the rollers of each roller set are arranged to cooperate in pairs, such that two adjacent upper rollers 16', 16'' together determine the shape or the width of the future lower flange 6' of the sheet 6, while two adjacent lower rollers 13', 13'' together determine the shape or width of the future upper flange 6''. It should also be noted that the roller pairs in both the upper roller set and the lower roller set are relatively widely spaced apart at the station shown in FIG. 7. In view hereof, the sheet section passing the station shown in FIG. 7 has imparted to it corrugations which are fairly shallow and wide as compared with the final profile.

In the subsequent working pass, i.e. when the same sheet section passes the subsequent station illustrated in FIG. 8, the sheet profile established in the preceding station is made deeper. To achieve this, the adjustable beam 14 of the station 2' has been slightly lowered in relation to the lower beam 11 such that the lower edge of the upper rollers 16 is at a notably lower level relative to the upper edge of the lower rollers 13, as compared with the station 2. At the station 2', furthermore, the roller pairs of both the upper and the lower roller set have been moved closer toward each other, as seen in a direction toward the central upper roller pair 16', 16''. In other words, while the sheet section is passing the station 2', its width is reduced, simultaneously as the sheet profile is made deeper.

In analogous manner, the wheels of the remaining subsequent working stations are reset such that the upper rollers are lowered relative to the lower rollers, simultaneously as cooperating pairs of rollers are moved successively farther in toward the sheet centre, whereby the depth of the sheet profile is successively increased until the desired final profile has been obtained.

As will appear from the above description, the corrugating rollers 13, 16 can be quickly and smoothly readjusted between different desired positions along the associated guides 12, 15, simultaneously as the adjustable beams 14 can be quickly and easily readjusted between different desired vertical positions relative to the fixed lower beam 11. This means that the entire machine can be quickly readapted from one type of profile to another optional type of profile. The fact that the corrugating rollers are individually mounted in accordance with the principle of the invention also implies that all slipping of the rollers relative to the sheet is avoided since the rollers can freely rotate at an optional peripheral speed which solely depends upon the sheet feeding rate determined by the drive wheels 32.

POSSIBLE MODIFICATIONS OF THE INVENTION

It will be appreciated that the invention is not restricted to the embodiment described above and illustrated in the drawings. For example, it is not absolutely necessary to make the corrugating rollers cooperate in pairs in the manner disclosed above; it is also conceivable to use a single roller for determining the shape or the width of the ridge or furrow in the sheet. Furthermore, it is conceivable to combine more than two cooperating rollers for determining the configuration of an individual furrow in the sheet, and also to make the lower rollers vertically adjustable, simultaneously as the upper rollers either are fixed or likewise are adjustably movable in the vertical direction. Although the screws 25, 25' are preferred for the vertical adjustment, it is of course also possible to effect raising and lowering by other suitable means. Instead of manually adjusting the rollers, in the manner described above, it is possible, in a development of the machine, to utilise automated mechanised movement and adjustment of the rollers both laterally and vertically. Such automation may preferably be controlled by a computer. Although it is much preferred in actual practice to form both corrugating devices of each station with individually mounted and individually rotating rollers, in the manner described above, it is per se conceivable to provide but one device with such rollers in order to cope with the above-mentioned slipping problem of prior art machines, in which case the other device can be provided with rollers or rings fixedly mounted on a common rotatable shaft. Instead of mounting the individual rollers on holders movable along guides in the preferred manner described above, it is also possible to mount the rollers on a common shaft with spacer members, such as tubular sleeves of different lengths, between the rollers for positioning thereof at desired locations along the shaft.

What is claimed:

1. A machine for corrugating sheet material, so as to provide a corrugated sheet having an upper flange forming a part of a corrugation and a lower flange forming a part of a corrugation comprising a plurality of successive working stations each provided with a corrugating device having upper and lower rotatable corrugating means adapted to jointly provide corrugations of successively increasing depth in a sheet which is successively advanced through the machine from a front station toward a rear station, wherein each corrugating device includes a plurality of spaced apart thin or disc-shaped rollers which are individually rotatable and adjustably movable in the direction of the axes of rotation and also lockable at desired spaced apart locations, wherein said plurality of rollers are formed into a set, each set comprising a pair of spaced rollers at the upper corrugating means and a corresponding cooperating pair of spaced rollers at the lower corrugating means with one of said pair of rollers of said upper or lower corrugating means being located between the other of said pair of rollers of said upper or lower corrugating means, one of said pairs of rollers of the upper or the lower corrugating means being spaced apart a distance greater than the other of said pair of rollers whereby a pair of adjacent rollers of an upper corrugating means determine the shape or width of a lower flange of the metal sheet and simultaneously a pair of adjacent rollers of the lower corrugating means determine the shape or width of an upper flange of said sheet, each roller being rotatably mounted on a separate holder which can be adjusted and locked in different positions along a guide which extends across the direction in which the sheet is advanced through the machine so that one roller of said pair of rollers of said upper or lower corrugating means is adjustable along the axis relative to the other roller of said pair of rollers of said upper or lower corrugating means.

2. A machine as claimed in claim 1, wherein each said guide is in the form of a rail with chamfered converging side surfaces, and said roller holder comprises a sliding block having two spaced-apart projections gripping the guide and having chamfered abutment surfaces in contact with said side surfaces, at least one projection being in the form of a pressure plate clampable against the associated guide side surface by means of a screw or clamp mechanism.

3. A machine as claimed in claim 1, wherein the lower corrugating device is stationary or fixedly mounted relative to a supporting framework, while the upper corrugating device is adjustable and lockable in different vertical positions relative to the lower corrugating device thereby to permit variation of the sheet corrugating depth at the station at issue.

4. A machine as claimed in claim 3, wherein said rollers of said upper corrugating device are mounted on a beam (14) which at opposite ends is in engagement with vertical guides or standards and with two rotatable screws for raising and lowering said beam.

5. A machine as claimed in claim 4, wherein said rotatable screws are synchronously rotatable screws.

* * * * *